US005907991A

United States Patent [19]

Ramamoorthy et al.

[11] Patent Number: 5,907,991

[45] Date of Patent: Jun. 1, 1999

[54] QUICK DROP VALVE CONTROL

[75] Inventors: Chandrasekar Ramamoorthy, Downers Grove; Steven P. Seaney, Glen Ellyn; Randall A. Harlow, Brimfield; John R. Connolly, Channahon, all of Ill.

[73] Assignee: Caterpillar Inc., Peoria, Ill.

[21] Appl. No.: 08/996,001

[22] Filed: Dec. 22, 1997

[51] Int. Cl.[6] ..... F15B 11/024

[52] U.S. Cl. ..... 91/436; 91/450

[58] Field of Search ..... 91/16, 18, 28, 91/29, 436, 450

[56] References Cited

U.S. PATENT DOCUMENTS

| | | | |
|---|---|---|---|
| 4,736,673 | 4/1988 | Harada et al. | 91/436 |
| 5,226,348 | 7/1993 | Dezelan et al. | 91/436 |
| 5,251,705 | 10/1993 | Waggoner et al. | 172/812 |
| 5,370,038 | 12/1994 | Poppe et al. | 91/436 |

*Primary Examiner*—F. Daniel Lopez

*Attorney, Agent, or Firm*—John W. Grant

[57] ABSTRACT

The present quick drop valve control provides both quick drop and float functions by moving a quick drop valve to a position interconnecting the drop and lift sides of a pair of lift cylinders when a directional control valve reaches a predefined position. The quick drop function valve is established by simultaneously energizing a first solenoid valve to communicate a shift end of the quick drop valve with a resolved pressure port of a resolver connected to the drop and lift sides and a first solenoid of a second solenoid valve to communicate a spring end of the quick drop valve with the drop sides so that the quick drop valve moves to the interconnecting position combining fluid expelled from the lift sides with fluid going to the drop side from a pump. The float function is established by simultaneously energizing the first solenoid valve to communicate the shift end of the quick drop valve with the resolved pressure port and a second solenoid of the second solenoid valve to communicate the spring end of the quick drop valve with the tank so that the quick drop valve moves to the interconnecting position effectively intercommunicating the pump, the tank and the lift sides and the drop sides of the lift cylinders.

8 Claims, 1 Drawing Sheet

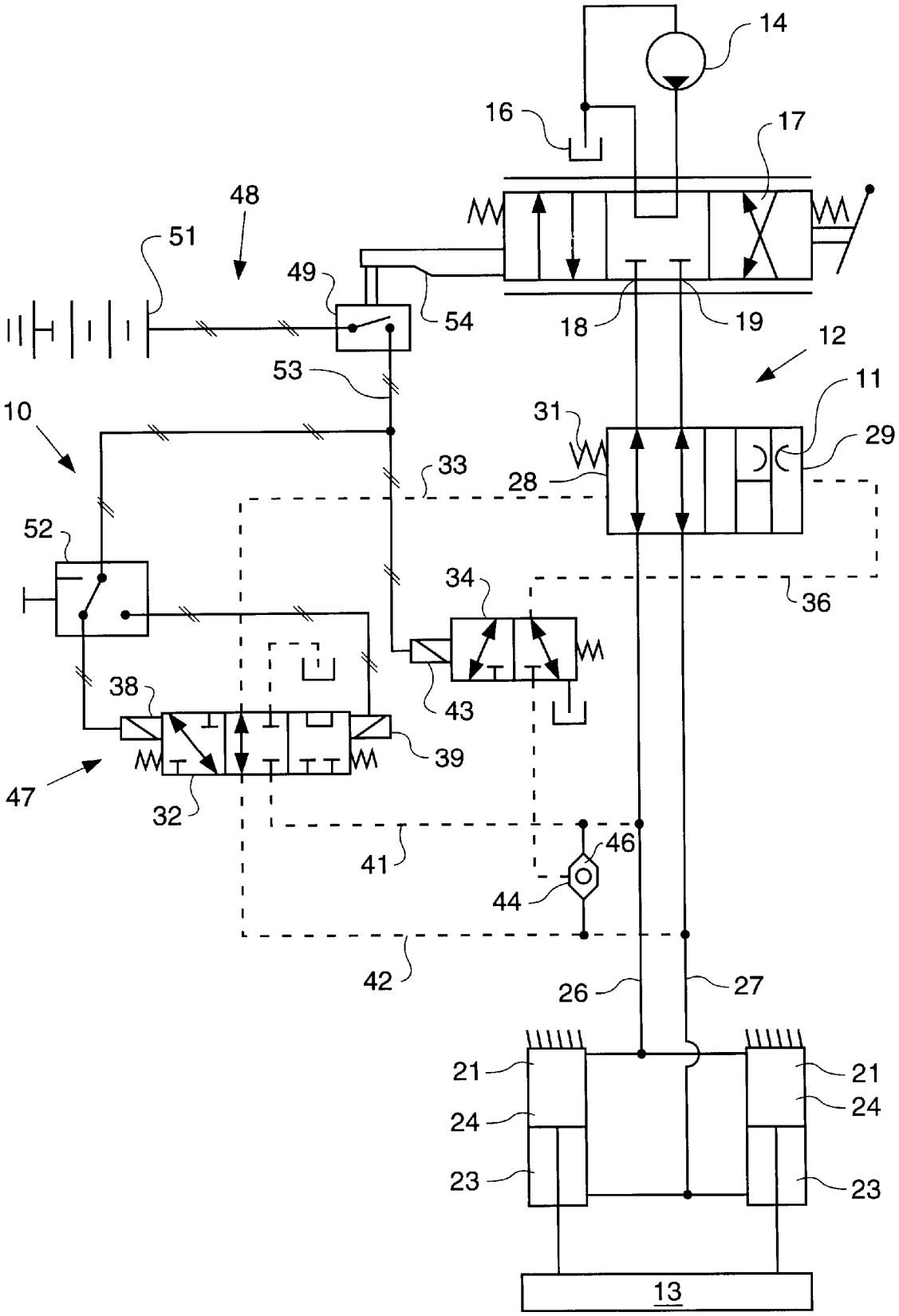
14
16
17
48
51
49
54
18
19
12
53
11
10
31
29
33
28
52
34
36
38
43
39
47
32
41
46
44
42
26
27
21
24
23
21
24
23
13

QUICK DROP VALVE CONTROL

TECHNICAL FIELD

This invention relates generally to quick drop valves for use with bulldozer blades and more particularly to a quick drop valve control which provides both quick drop and float functions.

BACKGROUND ART

Quick drop valves are commonly used in hydraulic systems for bulldozer blades and the like in which the blade is allowed to freefall to the ground under the force of gravity. The fluid expelled from the contracting lift sides of the double acting hydraulic lift cylinders is diverted by the quick drop valves to the expanding drop sides of the lift cylinders to supplement the pump flow thereto. Since the drop sides of the lift cylinders are essentially filled with fluid when the blade comes to rest on the ground, downward force can be quickly applied to the blade for penetrating the ground.

One known quick drop valve control disclosed in U.S. Pat. No. 5,226,348 uses a solenoid valve to direct load generated pressure from the lift side of the lift cylinders for moving a quick drop valve to its quick drop position when a directional control valve reaches a quick drop position so that fluid expelled from the lift sides is directed to the drop sides immediately after the blade begins to freefall. U.S. Pat. No. 5,251,705 discloses a similar type of quick drop valve control.

Bulldozer blades are sometimes used for cleanup operations wherein the blade is allowed to float along the surface and follow the surface contour without operator intervention. Typically, this is done by providing the directional control valve with a float position in which the lift and drop sides of the lift cylinders are interconnected with each other and with both the pump and the tank. Incorporating a float position in the directional control valve increases the length of both the valve body and the control spool and also the complexity of the porting in the valve body. One of the problems encountered with providing a float position in a bulldozer blade lift control system having an integrated quick drop valve is that the float position incorporated in the directional control valve is essentially a duplication of the quick drop position of the quick drop valve. Since both the directional control valve and the quick drop valve by necessity must be sized to handle larger fluid flows during the quick drop operations, providing the float position in the directional control valve unduly increases the cost of the lift control system.

Thus, it would be desirable to provide a quick drop valve control which controls the quick drop valve so that it can be used for both the quick drop and float functions.

The present invention is directed to overcoming one or more of the problems set forth above.

Disclosure of the Invention

In one aspect of the present invention, a quick drop valve control is used with a hydraulic system having a hydraulic pump, a tank, a hydraulic lift cylinder having a drop side and a lift side, and a control valve connected to the pump and the tank and having first and second motor ports connected to the drop and lift sides respectively. The control valve is movable from a neutral position through an intermediate operating position to a fully open position. The quick drop valve control comprises a quick drop valve hydraulically disposed between the control valve and the drop and lift sides of the lift cylinder and has a first position for communicating the first motor port with the drop side and the second motor port with the lift side and a second position for communicating both the drop and lift sides with the first motor port. The quick drop valve has first and second ends and a spring disposed at the first end resiliently biasing the quick drop valve to its first position. A resolver is connected to the drop and lift sides of the lift cylinder and has a resolved pressure port. A valve device has a first position for communicating the first end of the quick drop valve with the lift side of the lift cylinder and for communicating the second end of the quick drop valve with the tank. The valve device also has a quick drop position for communicating the first end of the quick drop valve with the drop side of the lift cylinder and for communicating the second end of the quick drop valve with the resolved pressure port of the resolver. A device moves the valve device to the second position when the control valve reaches the intermediate position.

BRIEF DESCRIPTION OF THE DRAWINGS

The sole FIGURE is a diagrammatic illustration of an embodiment of the present invention.

BEST MODE FOR CARRYING OUT THE INVENTION

A quick drop valve control 10 is operatively connected to a pilot operated quick drop valve 11 incorporated within a hydraulic system 12 which controls the position of a bulldozer blade 13 or the like. The hydraulic system 12 includes a hydraulic pump 14, a tank 16, a directional control valve 17 connected to the pump 14 and the tank 16 and having a pair of inlet-outlet motor ports 18,19, a pair of double acting hydraulic lift cylinders 21 with each lift cylinder having a lift side 23 and a drop side 24, and a pair of motor conduits 26,27 connecting the motor port 18 with the drop sides and the motor port 19 with the lift sides 23. The lift cylinders 21 are suitable connected to a work machine, not shown, and to the blade 13. The blade is acted on by gravity such that the weight thereof establishes a generally downward dropping direction tending to extend the lift cylinders. The control valve 17 is movable in both directions from the neutral load holding position shown to fully open positions and passes through a predefined intermediate operating position as hereinafter described.

The quick drop valve 11 is disposed in the motor conduits 26,27 and has a spring end 28, a shift end 29 and a spring 31 at the spring end 28 to resiliently bias the quick drop valve to the position shown.

The quick drop valve control 10 includes a three position solenoid valve 32 connected to the spring end 28 of the quick drop valve through a pilot line 33, and a two position solenoid valve 34 connected to the shift end 29 through a pilot line 36. The three position solenoid valve 32 has a pair of solenoids 38,39 disposed at its opposite ends and is connected to the motor conduits 26,27 through a pair of pilot lines 41,42 and to the tank. The two position solenoid valve 34 has a solenoid 43 at one end thereof and is connected to a resolved pressure port 44 of a resolver 46. The resolver 46 communicates with the lift and drop sides of the lift cylinders through the pilot lines 41,42 and the motor lines. Although the solenoid valves 32 and 34 are illustrated as separate valves, they both can alternatively be incorporated within a single valve.

The solenoid valves 32,34 constitute a valve means 47 having a first operative position for communicating the spring end 28 of the quick drop valve 11 with the lift sides 23 of the lift cylinders 21 and for communicating the shift end 29 of the quick drop valve with the tank 16, a quick drop position communicating the spring end 28 with the drop sides 23 of the lift cylinders and for communicating the shift end 29 with the resolved pressure port 44 of the resolver 46, and a float position communicating the spring end with the tank and for communicating the shift end with the resolved pressure port 44.

A means 48 is provided for selectively moving the valve means 47 to the quick drop position or the float position when the control valve reaches the intermediate position. The moving means 48 can be, for example, a normally open electrical switch 49 connected to a source of electrical energy such as a battery 51 and to the solenoid 43 of the solenoid valve 34 and a selector switch 52 through an electrical line 53, The selector switch 52 is connected to both solenoids 38 and 39 of the solenoid valve 32. The switch 49 is positioned at a location sufficient to be moved to the closed position, for example by a cam 54 suitably connected to the control valve 17 when the control valve reaches the intermediate position.

Industrial Applicability

The solenoid valves 32 and 34 are normally biased to the de-energized positions shown when the control valve is in its neutral fluid blocking position as shown. The quick drop valve 11 is also normally biased to the position shown to communicate the motor port 18 with the drop sides 24 of the lift cylinders 21 through the motor conduit 26 and the motor port 19 with the lift sides 23 of the lift cylinders 21 through the motor conduit 27. With the solenoid valve 34 in its de-energized position shown, the shift end 29 of the quick drop valve 11 is vented to the tank. The solenoid valve 32 communicates the lift sides 23 with the spring end 28 of the quick drop valve at its de-energized position. Thus if the blade 13 is being supported by the lift cylinders, load generated pressure in the lift sides is transmitted to the spring end 28 to aid the force of the spring 31 biasing the quick drop valve to the position shown.

To raise the blade 13, the operator moves the control valve 17 rightward to direct pressurized fluid from the pump 14 to the lift sides 23 of the lift cylinders 21 and to transmit fluid expelled from the drop sides 24 to the tank. Some of the pressurized fluid passes through the pilot line 42, the solenoid valve 32 and the pilot line 33 to the spring end 28 of the quick drop valve to maintain the quick drop valve in the position shown permitting unrestricted fluid flow therethrough.

To controllably lower the blade 13 from a raised position, the operator moves the control valve 17 leftward only part way from the neutral position to direct fluid from the pump 14 to the to the drop sides 24 of the lift cylinders 21 and to direct fluid expelled from the lift sides 23 to the tank 16. If the control valve is not moved sufficient for the cam 54 to close the switch 49, the solenoid valve 32 remains in the de-energized position so that some of the pressurized fluid expelled from the lift sides 23 is directed to the spring end 28 as previously described to maintain the quick drop valve 11 in the position shown so that it has no effect on lowering of the blade.

Permitting the blade 13 to freefall from the raised position is accomplished by moving the control valve 17 leftward to or beyond the predefined intermediate operating position at which the cam 54 closes the switch 49 to energize the solenoid 43 moving the solenoid valve 34 to its rightward energized position. This communicates the resolved pressure port 44 of the resolver 46 to the shift end 29 of the quick drop valve 11. Under this scenario, the pressure of the fluid being expelled from the lift sides 23 is higher than the pressure of the fluid directed to the drop sides 24 so that pressurized fluid in the motor conduit 27 is directed by the resolver 46 to the shift end 29. With the selector switch 52 in a quick drop position shown, the closing of the switch 49 also energizes the solenoid 38 which moves the solenoid valve 32 rightward to an energized quick drop position communicating the lower pressure fluid from the drop sides 24 to the spring end 28. The higher pressure fluid at the shift end 29 moves the quick drop valve to its leftward quick drop position causing the fluid expelled from the lift sides to combine with fluid being directed to the drop sides from the pump to aid in filling the expanding drop sides.

When the blade 13 contacts and is subsequently supported by the ground, expulsion of fluid from the lift sides 23 stops and the pressure in the lift sides, the motor conduit 27 and the pilot line 42 immediately goes to zero while the fluid in the drop sides 24, the motor conduit 26 and the pilot line 41 becomes pressurized. This causes the pressures at the spring end 28 and the shift end 29 to equalize and the quick drop valve 11 is moved back to the position shown by the spring 31 so that full pump pressure can be generated in the drop sides 23 of the lift cylinders 21 to exert a downward force on the blade even if the control valve 17 remains shifted beyond the intermediate position.

A float condition is established by shifting the selector switch 52 rightward to connect the electrical line 53 to the solenoid 39 of the solenoid valve 32 and moving the control valve 17 leftward sufficient for the cam 54 to close the switch 49. Closing the switch under this condition energizes both the solenoid 43 of the solenoid valve 34 and the solenoid 39 of the solenoid valve 32. The solenoid valve 34 is thus moved to its energized position communicating the resolved pressure port 44 with the shift end 29 of the quick drop valve and the solenoid valve 32 is moved to its leftward energized position communicating the spring end 28 to the tank. As noted above, leftward movement of the control valve 17 directs fluid from the pump 14 through the motor conduit 26 to the drop sides 24 and communicates the lift sides 23 with the tank through the motor conduit 27. With the spring side 28 vented to the tank, pressurized fluid generated in the motor conduit 26 is communicated by the resolver 46 and the solenoid valve 32 to the shift end 29. The pressurized fluid at the shift end moves the quick drop valve leftward against the bias of the spring 31 to interconnect the motor conduits 26,27 thereby effectively intercommunicating the pump, the tank and the lift sides and the drop sides of the lift cylinders. The position of the quick drop valve and the pressure generated in the motor conduit 26 is determined by the bias of the spring 31. The pressure in this embodiment is very low so that the blade can follow the contour of the ground without operator intervention.

In view of the foregoing, it is readily apparent that the structure of the present invention provides an improved quick drop valve control that allows the quick drop valve to provide both quick drop and float functions. This is accomplished by using first and second solenoid valves for controlling the position of the quick drop valve and energizing the solenoid valves when a directional control valve reaches a predefined position. The quick drop function is established by simultaneously energizing the first solenoid valve to communicate a shift end of the quick drop valve with a resolved pressure port of a resolver connected to the drop and lift sides of a pair of lift cylinders and a first solenoid of the second solenoid valve to communicate a spring end of the quick drop valve with the drop sides of the lift cylinders. The higher pressure of the fluid being expelled from the lift sides is thus directed to the shift end to move the quick drop valve to a position interconnecting the drop and lift sides so that fluid expelled from the lift sides combines with the fluid going to the drop side from a pump. The float function is established by simultaneously energizing the first solenoid valve to communicate the shift end of the quick drop valve with the resolved pressure port and a second solenoid of the second solenoid valve to communicate the spring end of the quick drop valve with the tank. Fluid pressure generated in the drop sides is thus directed to the shift end to move the quick drop valve to a position interconnecting the drop and lift sides thereby effectively intercommunicating the pump, the tank and the lift sides and the drop sides of the lift cylinders.

Other aspects, objects and advantages of this invention can be obtained from a study of the drawings, the disclosure and the appended claims.

We claim:

1. A quick drop valve control adapted for use with a hydraulic system having a hydraulic pump, a tank, a hydraulic lift cylinder having a drop side and a lift side, and a control valve connected to the pump and the tank and having first and second motor ports connected to the drop and lift sides respectively, the control valve being movable from a neutral position through an intermediate operating position to a fully open position, the quick drop valve control comprising:

a quick drop valve hydraulically disposed between the control valve and the drop and lift sides of the lift cylinder and having a first position for communicating the first motor port with the drop side and the second motor port with the lift side and a second position for communicating both the drop and lift sides with the first motor port, the quick drop valve having first and second ends and a spring disposed at the first end resiliently biasing the quick drop valve to its first position;

a resolver connected to the drop and lift sides of the lift cylinder and having a resolved pressure port;

valve means having a first position for communicating the first end of the quick drop valve with the lift side of the lift cylinder and for communicating the second end of the quick drop valve with the tank, and a quick drop position for communicating the first end of the quick drop valve with the drop side of the lift cylinder and for communicating the second end of the quick drop valve with the resolved pressure port of the resolver; and means for moving the valve means to the quickdrop position when the control valve reaches the intermediate position.

2. The quick drop valve control of claim 1 wherein the valve means has a float position for communicating the first end of the quick drop valve with the tank and for communicating the second end of the quick drop valve with the resolved pressure port.

3. The quick drop valve control of claim 2 wherein the valve means includes a solenoid valve connected to the resolved pressure port of the resolver and to the second end of the quick drop valve, the solenoid valve having a de-energized position for communicating the second end with the tank and an energized position for communicating the second end with the resolved pressure port.

4. The quick drop valve control of claim 3 wherein the valve means includes a second solenoid valve connected to the drop and lift sides of the lift cylinder and to the first end of the quick drop valve, the second solenoid valve having a de-energized position for communicating the first end with the lift side and an energized position for communicating the first end with the drop side.

5. The quick drop valve control of claim 4 wherein the second solenoid valve has another energized position for communicating the first end of the quick drop valve with the tank.

6. The quick drop valve control of claim 5 wherein each of the solenoid valves has a solenoid and the moving means includes a source of electrical energy and an electrical switch connected to the electrical source and to the solenoids.

7. The quick drop valve control of claim 6 wherein the electrical switch is positioned at a location to be closed when the control valve reaches its intermediate position.

8. The quick drop valve control of claim 7 wherein the second solenoid valve has second solenoid and the moving means includes a selector switch disposed between the electrical switch and both solenoids of the second solenoid valve.

* * * * *